US010022772B1

(12) United States Patent
Huang

(10) Patent No.: US 10,022,772 B1
(45) Date of Patent: Jul. 17, 2018

(54) QUICK POSITIONING TUBE EXPANDER

(71) Applicant: POUL CHANG METAL INDUSTRY CO., LTD., Taichung (TW)

(72) Inventor: Chia-Hao Huang, Taichung (TW)

(73) Assignee: POUL CHANG METAL INDUSTRY CO., LTD., Taichung (TW)

( * ) Notice: Subject to any disclaimer, the term of this patent is extended or adjusted under 35 U.S.C. 154(b) by 0 days.

(21) Appl. No.: 15/481,989

(22) Filed: Apr. 7, 2017

(51) Int. Cl.
*B21D 41/02* (2006.01)
*B21D 19/10* (2006.01)

(52) U.S. Cl.
CPC ..... *B21D 41/021* (2013.01); *B21D 19/10* (2013.01); *B21D 41/02* (2013.01)

(58) Field of Classification Search
CPC ..... B21D 41/021; B21D 41/02; B21D 19/10
USPC ..... 72/370.1, 317, 370.03
See application file for complete search history.

(56) References Cited

U.S. PATENT DOCUMENTS 2,357,748 A * 9/1944 Lyon ..... B21D 39/06 29/512
3,421,354 A * 1/1969 Strybel ..... B21D 39/06 72/317
4,779,441 A * 10/1988 Pringle ..... B21D 41/021 72/316
6,062,060 A * 5/2000 Nguyen ..... B21D 17/02 72/317
6,199,421 B1 * 3/2001 Ploeger ..... B21D 41/021 72/317

* cited by examiner

*Primary Examiner* — David B Jones
(74) *Attorney, Agent, or Firm* — WPAT, PC

(57) ABSTRACT

A quick positioning tube expander includes a clamp mold having a first clamp block and a second clamp block; a pivoting assembly pivotally disposed on the clamp mold for the first and second clamp blocks to open and close with the pivoting assembly as a center of pivoting; and a positioning member. The tube channel is disposed between the first and second clamp blocks for containing a tube body. The first clamp block has a first through hole and a second through hole mutually spaced, and the tube channel is connected with the first and second through holes. The positioning member is connected with the first through hole. The tube body passes through the second through hole to be contained in the tube channel with an end part of the tube body resisting against an end surface of the positioning member to be positioned.

13 Claims, 8 Drawing Sheets

QUICK POSITIONING TUBE EXPANDER

BACKGROUND OF THE INVENTION

1. Field of the Invention

The present invention relates to tube expanders, and more particularly, to a quick positioning tube expander.

2. Description of the Related Art

As disclosed in known arts, a tube expanding device with sight hole is disclosed, comprising: a pair of molds provided with an upper mold, a lower mold, and plural fixing members. The upper mold has plural upper fastening holes and an upper sight hole; the lower mold has plural lower fastening holes and a lower sight hole. When the upper mold and the lower mold are coupled and fixed, the plural upper and lower fastening holes correspondingly form plural fastening holes, through where plural fixing members are screwed, whereby the upper and lower molds are fastened and combined into a whole, and the upper and lower sight hole forms a sight hole passing through the whole mold. A deforming member is further included, comprising at least a deforming portion and at least a propelling portion. The deforming portion is applied for moving toward a deformation portion to carry out a deforming operation, and the sight hole is applied for examining the internal part of the mold.

Because the plural fixing members are screwed into the fastening holes prior to the tube expanding process of the tube expanding device, so as to fastening the upper and lower molds together. Also, the sight hole is applied for checking if the tube body is properly positioned before the deforming member expanding the tube body. Therefore, during a tube expanding operation, the fastening process for combining the upper and lower mold is time consuming. Also, regarding positioning the tube body by visually checking, an error of sight easily occurs, causing the tube body to be not properly positioned. As a result, the tube diameter error of the expanded tube possibly exists and may be unfavorable for the brake wire disposition operation. Therefore, improvements upon the time demand for combining the upper and lower molds and the accuracy of the tube body positioning process are desirable.

SUMMARY OF THE INVENTION

For improving the issues above, a quick positioning tube expander in accordance with embodiments of the present invention is disclosed. By pivotally connecting a first clamp block and a second clamp block, the two blocks are able to open and close against each other. Also, a position limiting member is disposed at a position of a tube to-be-expanded, wherein the tube body resists against an end surface of the positioning member. With such configuration, time cost for fastening plural fastening members is saved, achieving a quick fastening effect and efficiently positioning the tube body with great accuracy.

For achieving the aforementioned objectives, an embodiment of the present invention provides a quick positioning tube, comprising:

a clamp mold provided with a first clamp block and a second clamp block, a tube channel disposed between the first clamp block and the second clamp block for containing a tube body, the first clamp block provided with a first through hole and a second through hole that are spaced with each other, the tube channel connected with the first and second through holes;

a pivoting assembly pivotally disposed on the clamp mold, such that the first and second clamp blocks open and close against each other with the pivoting assembly as a center of pivoting; and a positioning member connected with the first through hole, wherein the tube body passing through the second through hole to be contained in the tube channel with an end of the tube body resisting against an end surface of the positioning member to be positioned.

With such configuration, the first and second clamp blocks are able to pivot for opening and closing against each other through the pivoting assembly disposed therebetween. The complicated fastening and coupling process prior to the tube expanding operation is saved. Thus, a quick fastening effect is realized. In addition, the positioning member is placed at a position of the tube to-be-expanded prior to the tube expanding operation, such that the tube body is able to resist against the end surface of the positioning member, whereby the tube body is accurately positioned at the tube expanding place. Therefore, the conventional method of visual position checking step is improved, facilitating the quick positioning function.

DETAILED DESCRIPTION OF THE INVENTION

Figure 1:
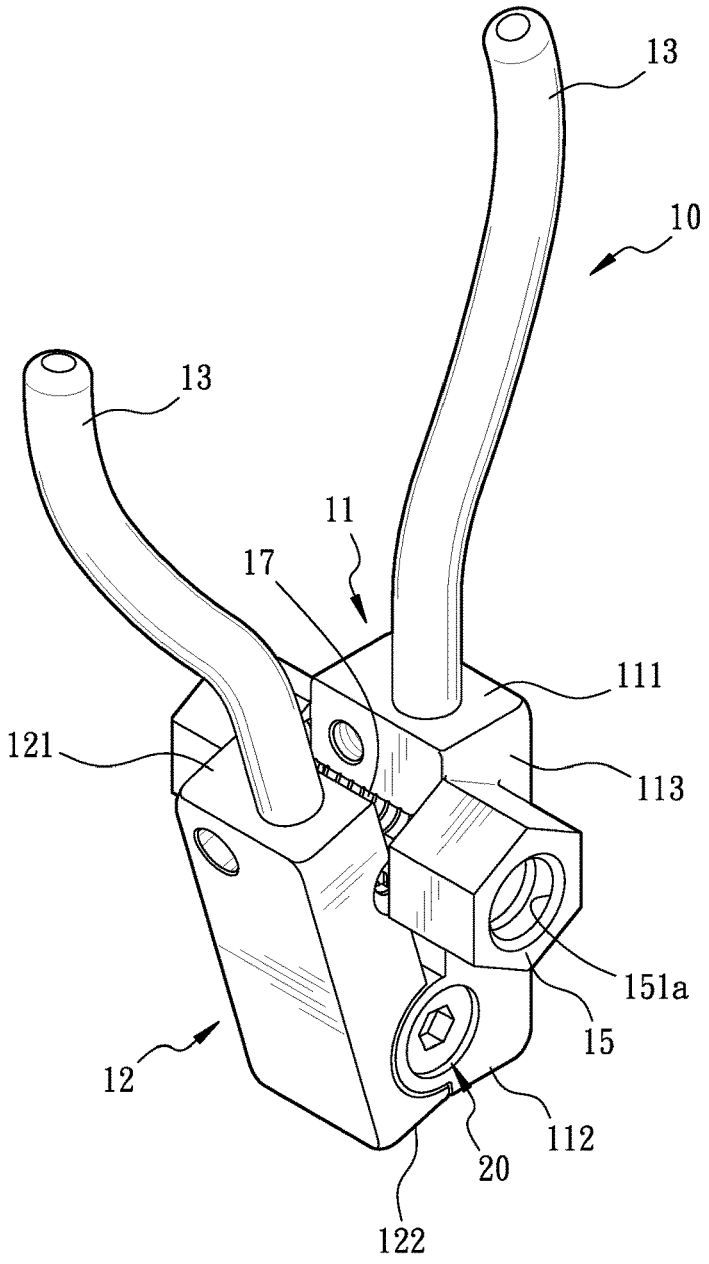
FIG. 1 is a perspective view of the tube expander in accordance with an embodiment of the present invention.
Figure 2:
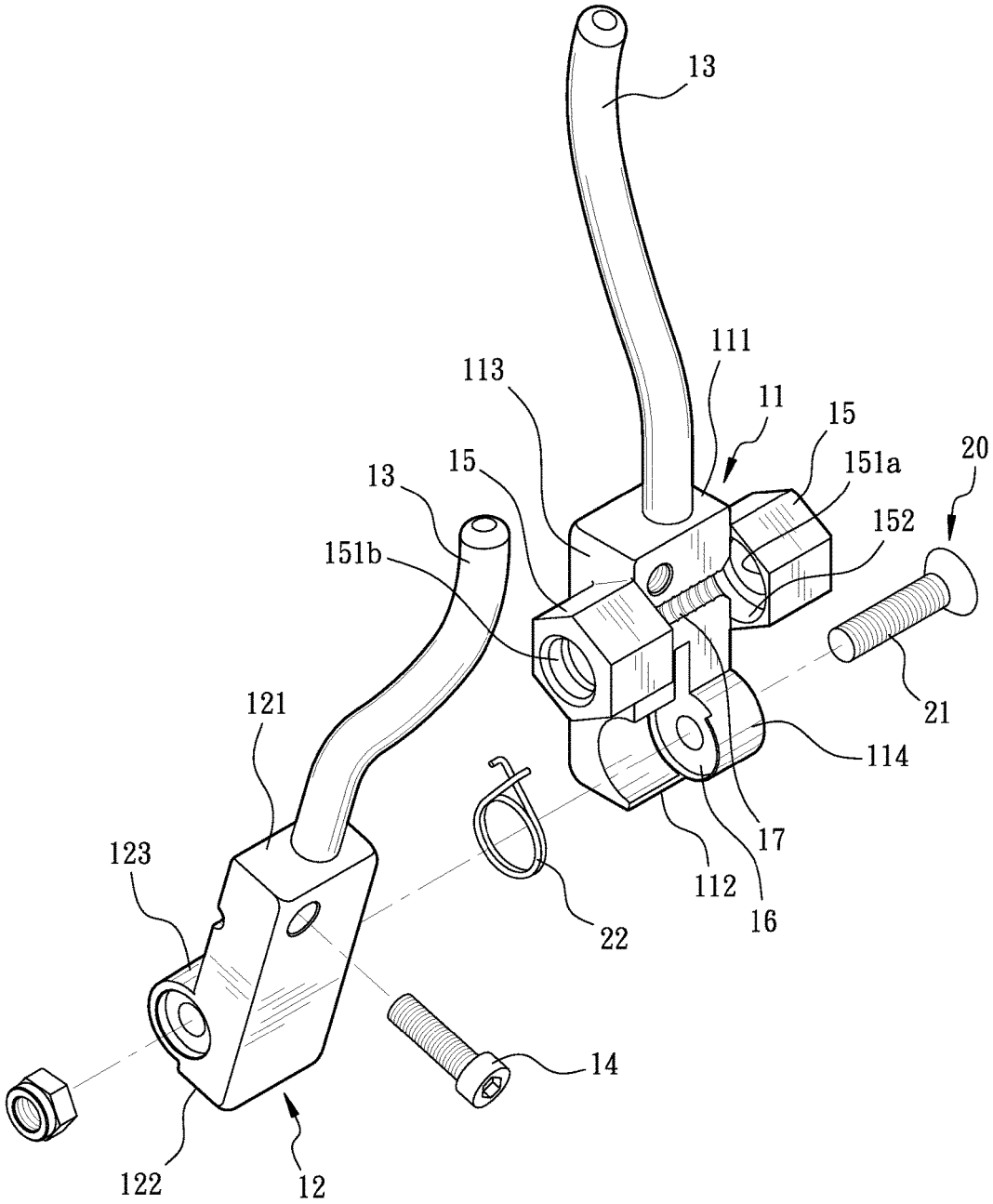
FIG. 2 is an exploded view of the tube expander in accordance with an embodiment of the present invention.

The aforementioned and further advantages and features of the present invention will be understood by reference to the description of the preferred embodiment in conjunction with the accompanying drawings where the components are illustrated based on a proportion for explanation but not subject to the actual component proportion.

Referring to FIG. 1 to FIG. 8, an embodiment of the tube expander in accordance with the present invention comprises a clamp mold 10, a pivoting assembly 20, and a positioning member 30.

The clamp mold 10 is provided with a first clamp block 11, a second clamp block 12, and two handles 13 disposed on the first clamp block 11 and the second clamp block 12, respectively. With a pivoting assembly 20 pivotally disposed in the clamp mold 10, the first clamp block 11 and the second clamp block 12 pivot to open and close against each other with the pivoting assembly 20 as the center of pivoting. The first clamp block 11 and the second clamp block 12 are allowed to be coupled by manually pressing the two handles 13 or by use of a fastening member. In an embodiment of the present invention, a fixing member 14 is provided to fasten the first clamp block 11 and the second clamp block 12. When the two handles 13 are pressed to couple the first clamp block 11 and the second clamp block 12, the fixing member 14 is applied for fastening the first clamp block 11 and the second clamp block 12 together.

In addition, the first clamp block 11 is provided with a first opening end 111, a first pivoting end 112 disposed in opposite to the first opening end 111, and two outer sides 113 disposed between the first opening end 111 and the first pivoting end 112, wherein a handle 13 is disposed on the first opening end 111, and a first pivoting portion 114 is disposed on the first pivoting end 112, with a positioning portion 15 disposed on the two outer sides 113, respectively. One of the two positioning portions 15 is provided with a first through hole 151*a*, and the other one positioning portion 15 is provided with a second through hole 151*b*, wherein the two positioning portions 15 are internally and peripherally provided with a recess 152, respectively. One of the two recesses 152 is connected with the first through hole 151*a*, while the other one of the recess 152 is connected with the second through hole 151*b*. The diameter of the two recess 152 is larger than or equal to the bore diameter of the first through hole 151*a* and the second through hole 151*b*. In an embodiment of the present invention, the diameter of the two recesses 152 is larger than the diameter of the first though hole 151*a* and the second through hole 151*b*. Also, a second inner wall 154 is disposed on one lateral side of the first clamp block 11 and defines one side of one of the recesses 152, and a first inner wall 153 defining the other side of the recess 152 is disposed in vertical against a barrel shaped inner face surrounding the first through hole 151*a*, wherein the first inner wall 153 and the second inner wall 154 are arranged in parallel to each other, with the second inner wall 154 facing the first through hole 151*a*. In an embodiment of the present invention, inner structures of the two positioning portions 15 are identical. Therefore, regarding the other one of the two positioning portions 15, a second inner wall 154 is disposed on the other lateral side of the first clamp block 11 and defines one side of the other recesses 152, and a first inner wall 153 defining the other side of the recess 152 is disposed in vertical against a barrel shaped inner face surrounding the second through hole 151*b*, wherein the first inner wall 153 and the second inner wall 154 are arranged in parallel to each other, with the second inner wall 154 facing the second through hole 151*b*.

Furthermore, the second clamp block 12 is disposed between the two positioning portions 15, and provided with a second opening end 121 and an opposite second pivoting end 122. The second opening end 121 correspondingly faces the first opening end 111; the second pivoting end 122 correspondingly faces the first pivoting end 112. The other handle 13 is disposed on the second opening end 121. The second pivoting end 122 is provided with a second pivoting portion 123. In an embodiment of the present invention, a groove 16 is disposed between the first pivoting portion 114 and the second pivoting portion 123.

Figure 3:
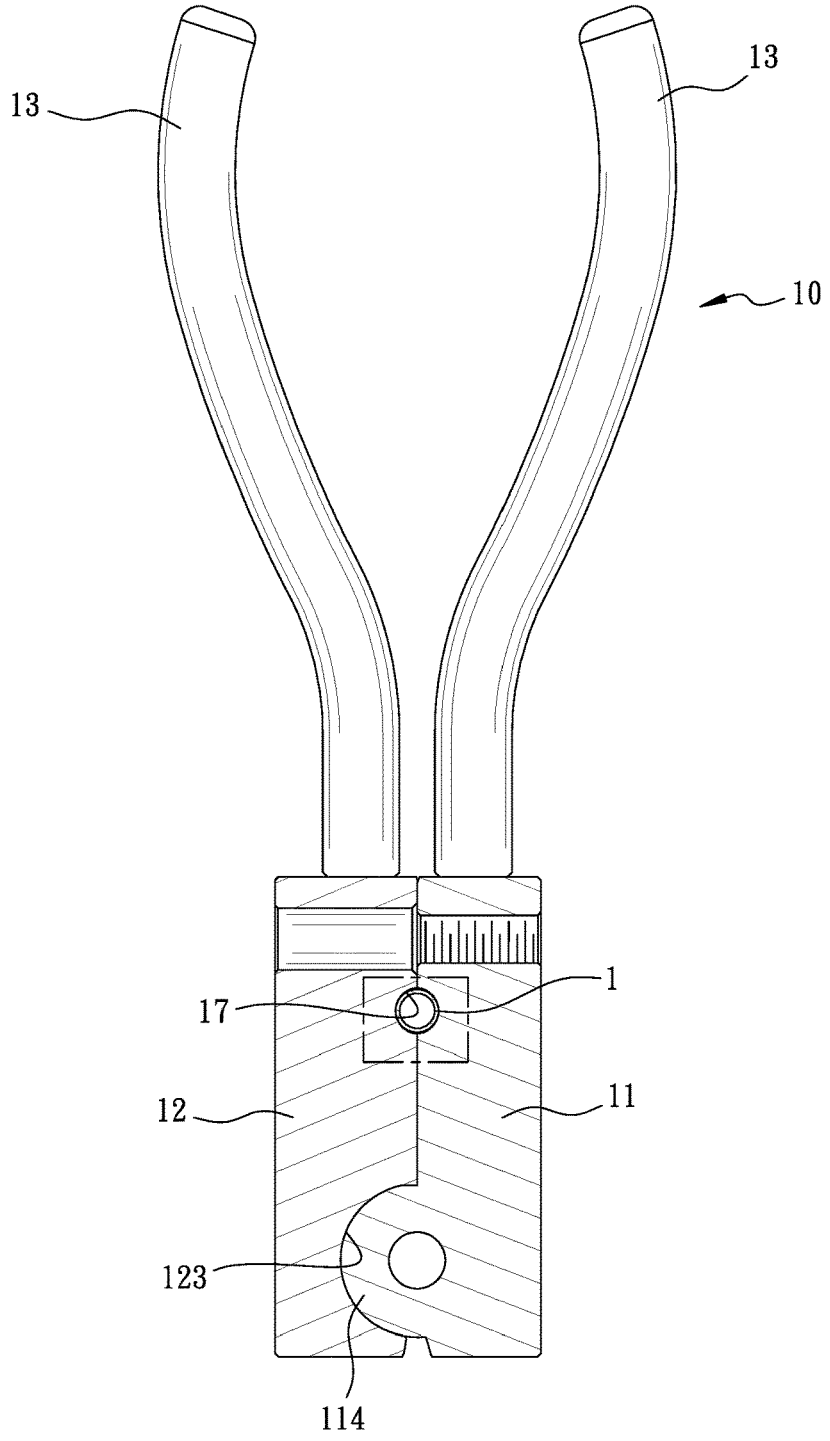
FIG. 3 is a view of the tube expander, illustrating the tube body being contained in the tube channel.
Figure 4:
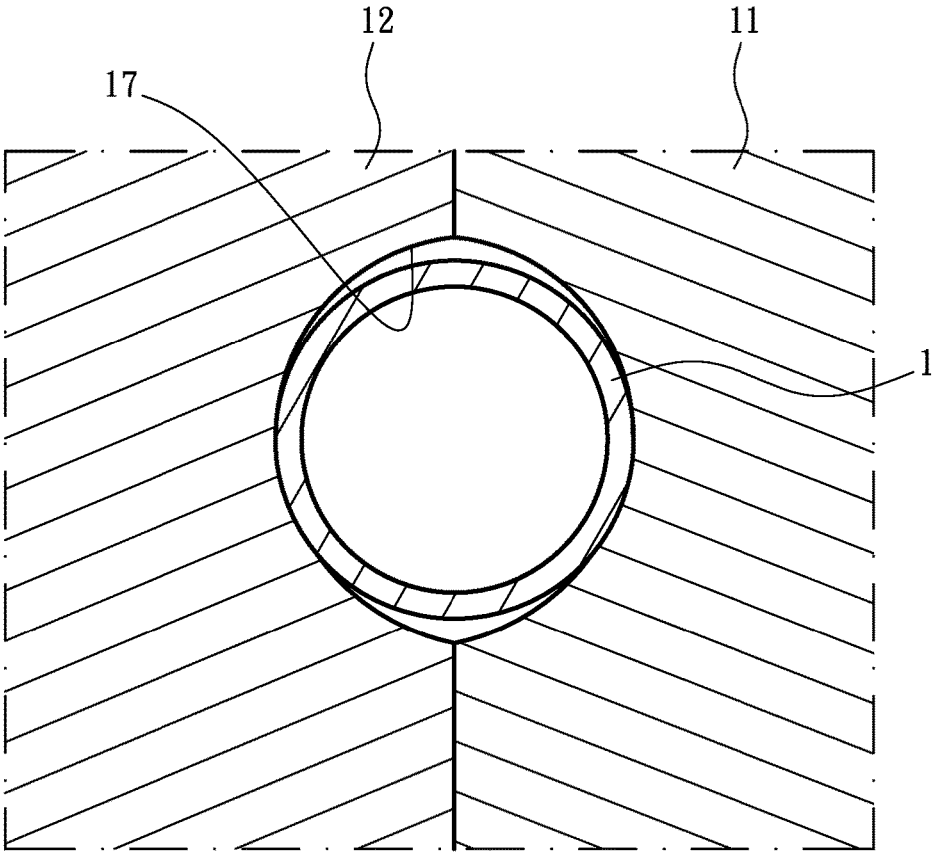
FIG. 4 is a partially enlarged view of FIG. 3, illustrating the section of the tube channel not being a full circle.

In addition, a tube channel 17 is disposed between the first clamp block 11 and the second clamp block 12 for containing a tube body 1. The tube channel 17 is connected with the first through hole 151*a*, the second through hole 151*b*, and the two recesses 152, such that the tube body 1 is allowed to pass through the first through hole 151*a* and contained in the tube channel 17. The diameter of the two recesses 152 is larger than or equal to the diameter of the tube channel 17. In an embodiment of the present invention, the diameter of the two recesses 152 is larger than the diameter of the tube channel 17. Further, in an embodiment of the present invention, the tube channel 17 is formed in two arcs and disposed on the first clamp block 11 and the second clamp block 12, respectively. When the first clamp block 11 and the second clamp block 12 are coupled with each other, the section of the tube channel 17 is not formed in a full circle. In an embodiment of the present invention, as shown by FIG. 3 and FIG. 4, the section of the tube channel 17 is formed in an oval shape and provided with thread structure, so as to enhance the fixing effect thereby cast upon the tube body 1, thus preventing the tube body 1 from sliding in the tube channel 17 and facilitating an accurate positioning function. Also, in an embodiment of the present invention, two end portions of the tube channel 17 are formed in different shapes, wherein one end thereof is formed in a horn shape, while the other is formed in a flat shape. Therefore, the tube expander of the present invention is able to be applied based on different tube expanding shape requirements, enhancing the utility of the present invention.

The pivoting assembly 20 is provided with an axle member 21 and a resilient member 22. The axle member 21 pass through the first pivoting portion 114 and the second pivoting portion 123, such that the first clamp block 11 and the second clamp block 12 are able to open and close against each other with the axle member 21 as the center of pivoting. The resilient member 22 is disposed in the groove 16 between the first pivoting portion 114 and the second pivoting portion 123, so that the first clamp block 11 and the second clamp block 12 are kept being spaced against each other. When the user screws the fixing member 14 away from the clamp mold 10 and releases the hands that were once pressing, the resilient member 22 separates the first clamp block 11 and the second clamp block 12.

Figure 5:
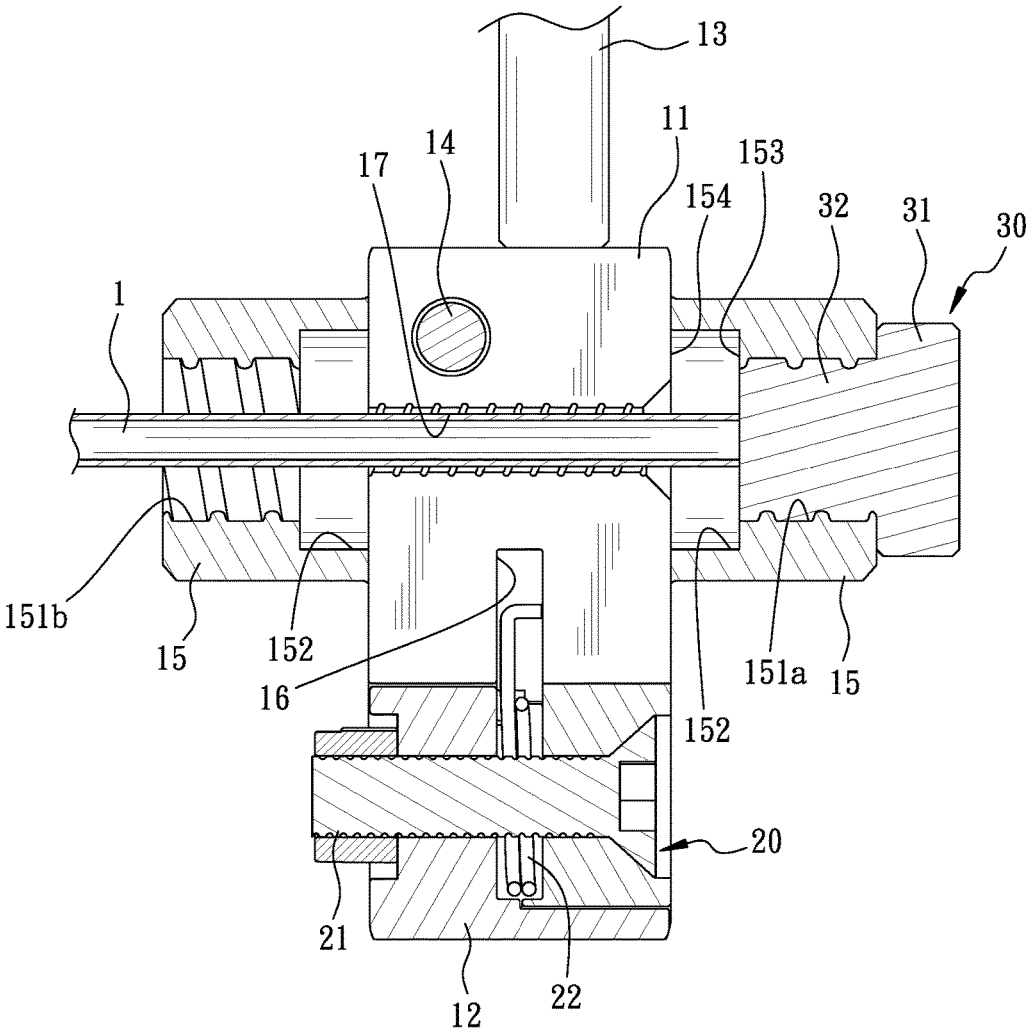
FIG. 5 is a cross-sectional view taken along the direction in axial alignment with the pivoting assembly, illustrating the positioning member disposed in the through hole, wherein one end of the positioning member flushes with an inner wall of the positioning portion at the periphery of the through hole.
Figure 7:
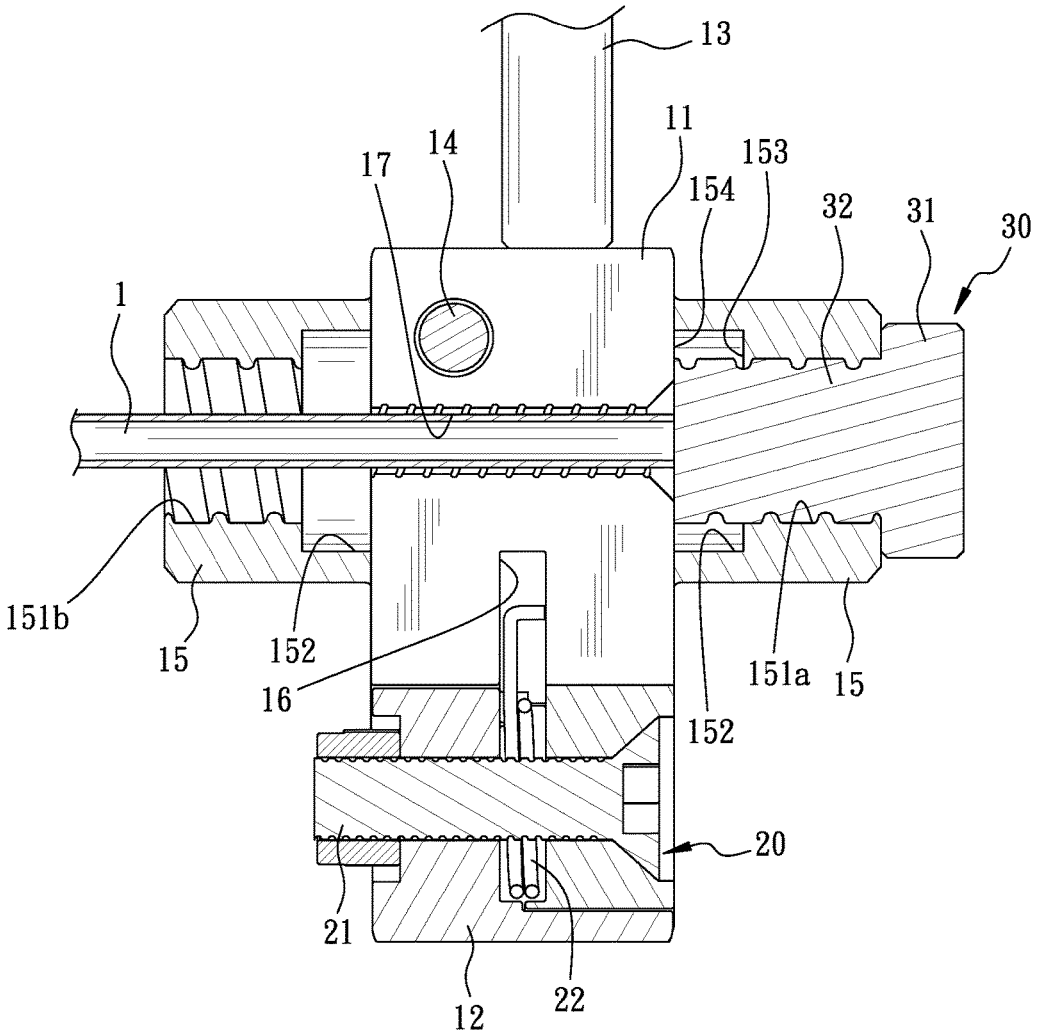
FIG. 7 is another cross-sectional view illustrating the positioning member disposed in the through hole, wherein one end of the positioning member flushes an inner wall of the periphery of an end of the tube channel.

The positioning member 30 is connected with the first through hole 151*a* or the second through hole 151*b* in a manner of being fastened to or inserted therein, or covering the outer side of the first through hole 151*a* or the second through hole 151*b*. Also, the positioning member 30 is able to be removed away from the end part of the tube body 1. In an embodiment of the present invention, as shown by FIG. 5 or FIG. 7, the positioning member 30 is screwed into the first through hole 151*a*; when the tube body 1 passes through the second through hole 151*b* to be contained in the tube channel 17, an end part of the tube body 1 resists against an end surface of the positioning member 30, so as to be positioned. Also, the positioning member 30 is provided with a position limiting portion 31 and an aligning portion 32 disposed in opposite to the position limiting portion 31. The position limiting portion 31 resists against the outer side of the first through hole 151*a*, and the aligning portion 32 passes through the first through hole 151*a*. An end surface of the aligning portion 32 is resisted by the end part of the tube body 1. When the positioning member 30 is moved away from the end part of the tube body 1, an expanding member 2 is allowed to be screwed into the first through hole 151*a*, whereby the expanding member 2 expands the diameter of the end part of the tube body 1.

Figure 6:
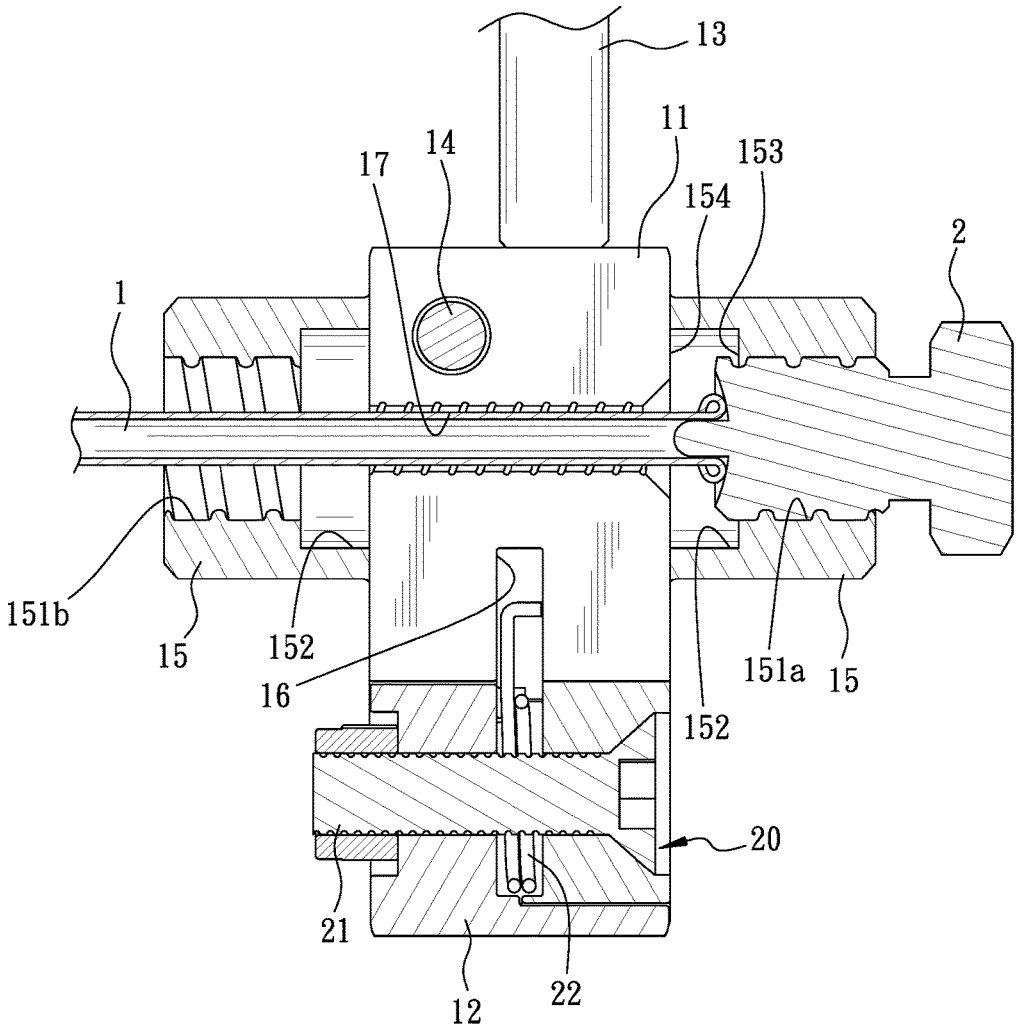
FIG. 6 is another cross-sectional view illustrating the expanding member disposed in the through hole, such that an end of the tube body is expanded in the recess.

Referring to FIG. 5 and FIG. 6 the end surface of the aligning portion 32 flushed with the first inner wall 153, so that the end part of the tube body 1 resists against the aligning portion 32. When the positioning member 30 is moved away from the end part of the tube body 1, the expanding member 2 is screwed into the first through hole 151*a*, whereby the diameter of the end part of the tube body 1 is expanded in the recess 152.

Figure 8:
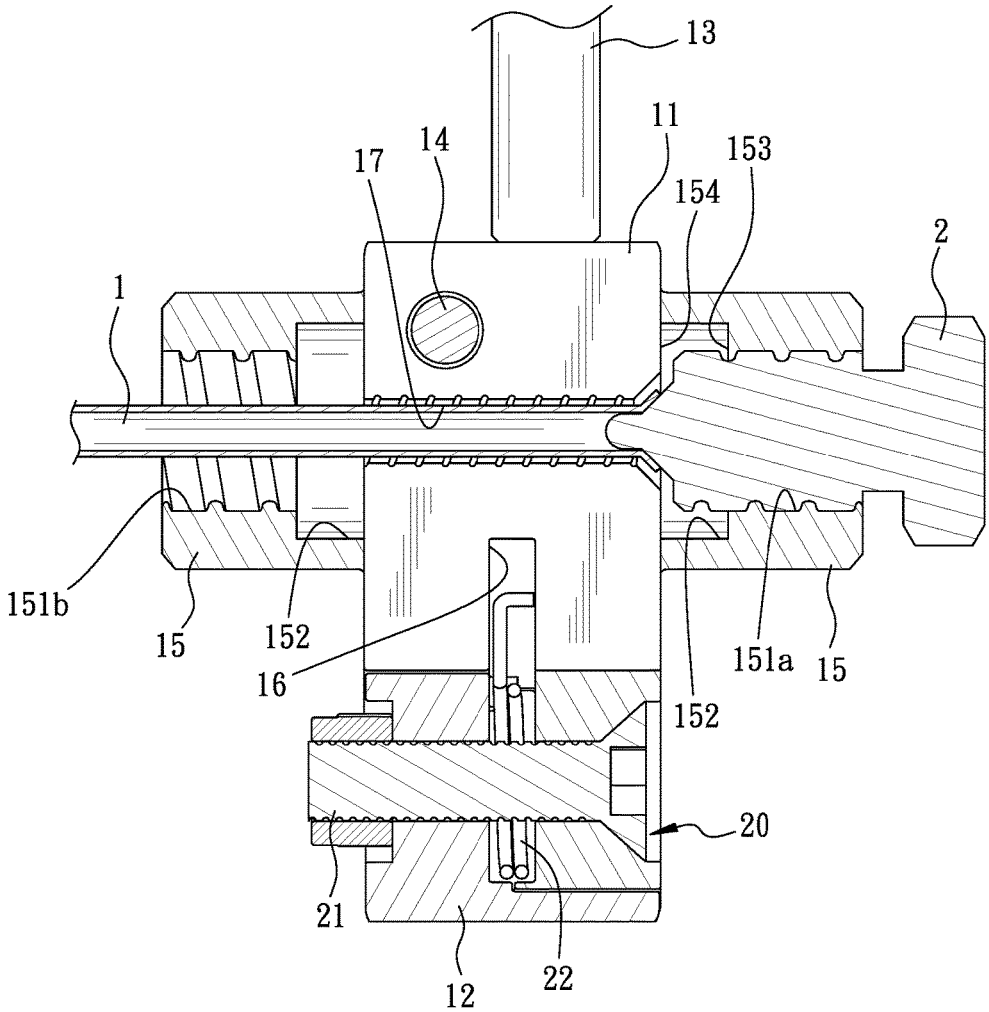
FIG. 8 is another cross-sectional view illustrating the expanding member disposed in the through whole, such that and end of the tube body is expanded in one end of the tube channel.

Referring to FIG. 7 and FIG. 8, the end surface of the aligning portion 32 flushed with the second inner wall 154, so that the end part of the tube body 1 resists against the aligning portion 32. When the positioning member 30 is moved away from the end part of the tube body 1, the expanding member 2 is screwed into the first through hole 151*a*, whereby the diameter of the end part of the tube body 1 is expanded in the tube channel 17. Furthermore, in an embodiment of the present invention, the end part of the tube body 1 is allowed to be expanded into a horn shape or oval shape for meeting different user demands. Therefore, when the end part of the tube body 1 is to be expanded into a horn shape, the tube body 1 is inserted into the tube channel 17 from the second through hole 151*b* firstly, and the expanding member 2 is then screwed into the first through hole 151*a* for expanding the diameter of the end part of the tube body 1 into a horn shape. On the other hand, if the end part of the tube body 1 is to be expanded into an oval shape, the tube body 1 is inserted to into the tube channel 17 from the first through hole 151*a*, and the expanding member 2 is then screwed into the second through hole 151*b* for expanding the diameter of the end part of the tube body 1 into an oval shape which is correspondingly matched with the sectional shape of the tube channel 17.

Therefore, when the tube body 1 pass through the first through hole 151*a* and contained in the tube channel 17, the tube body 1 is positioned by use of the end surface of the aligning portion 32 of the positioning member 30, and the first clamp block 11 and the second clamp block 12 pivot to open and close through the pivoting assembly 20. When the two handles 13 are manually pressed by hands of the user to couple the first clamp block 11 and the second clamp block 12, with the first clamp block 11 and the second clamp block 12 being fastened by the fixing member 14, the positioning member 30 is then moved away from the end surface of the tube body 1, and the expanding member 2 is screwed into the same through hole 151, whereby the diameter of the end part of the tube body 1 is expanded. In addition, two ends of the tube channel 17 are used to form different shapes according to different user demands. Therefore, the end part of the tube body 1 is allowed to be placed in one of the ends of the tube channel 17 according to a target shape to be formed, saving the necessity of switching to another different tube expander, thus enhancing the utility of the present invention.

With such configuration, when the tube body 1 is inserted into the clamp mold 10 before being expanded, the positioning member 30 provides an accurate positioning function. The user needs only to resists the tube body 1 against the end surface of the aligning portion 32 to achieve a quick positioning effect. Also, the first clamp block 11 and the second clamp block 12 are efficiently coupled by use of the pivoting assembly 20. Therefore, prior to the tube expanding operation, the complicated fastening and coupling processes are saved, achieving a quick fastening and positioning effect.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A quick positioning tube expander, comprising:

a clamp mold provided with a first clamp block and a second clamp block, a tube channel disposed between the first clamp block and the second clamp block for containing a tube body, the first clamp block provided with a first through hole and a second through hole that are spaced with respect to each other, the tube channel connected with the first and second through holes;

a pivoting assembly pivotally disposed on the clamp mold, such that the first and second clamp blocks pivot on the pivoting assembly to open and close against each other; and a positioning member connected with the first through hole, the tube body passing through the second through hole to be contained in the tube channel with an end part of the tube body is disposed against an end surface of the positioning member.

2. The tube expander of claim 1, wherein a cross-section of the tube channel has a vesica piscis shape.

3. The tube expander of claim 1, wherein the positioning member is screwed or inserted in the first through hole, and the positioning member is movable with respect to the end part of the tube body.

4. The tube expander of claim 3, further comprising an expanding member; wherein when the positioning member is moved away from the end part of the tube body, the expanding member passes through the first through hole and expands a diameter of the end part of the tube body.

5. The tube expander of claim 1, wherein the positioning member comprises:

a position limiting portion; and an aligning portion;

wherein the position limiting portion is disposed against an outer side of the first through hole, the aligning portion passing through the first through hole, the end part of the tube body disposed against an end surface of the aligning portion.

6. The tube expander of claim 5, wherein two sides of the first clamp block are provided with two positioning portions, respectively the second clamp block is disposed between the two positioning portions the first through hole is disposed on one of the two positioning portions, and the second through hole is disposed on the other of the two positioning portions.

7. The tube expander of claim 6, wherein the two positioning portions comprise two internal recesses, respectively, the two internal recesses are connected with the tube channel and the two through holes, diameters of the two internal recesses are each larger than or equal to a diameter of the tube channel, and the diameters of the two internal recesses are each larger than or equal to a diameters of the two through holes.

8. The tube expander of claim 7, wherein a first inner wall is disposed vertically against a barrel shaped inner face surrounding the first through hole, and the end surface of the aligning portion is flush with the first inner wall.

9. The tube expander of claim 7, wherein a second inner wall is disposed on one lateral side of the first clamp block and faces the first through hole, and the end surface of the aligning portion is flush with the second inner wall.

10. The tube expander of claim 7, wherein a second inner wall is disposed on one lateral side of the first clamp block and defines one side of the recess, and a first inner wall defining the other side of the recess is disposed vertically against a barrel shaped inner face surrounding the first through hole, the first inner wall and the second inner wall are arranged in parallel to each other with the second inner wall facing the first through hole, and the end surface of the aligning portion is alternatively flush with one of the first and second inner walls.

11. The tube expander of claim 1, wherein the pivoting assembly is provided with a resilient member disposed between the first clamp block and the second block, wherein the resilient member applies a separating force between the first clamp block and the second clamp block.

12. The tube expander of claim 1, further comprising a fixing member passing through the first clamp block and the second clamp block, so as to fasten and couple the first clamp block and the second clamp block.

13. The tube expander of claim 1, wherein the clamp mold comprises two handles disposed on the first clamp block and the second clamp block, respectively.

* * * * *